US005637830A

United States Patent [19]

Hashizawa et al.

[11] Patent Number: 5,637,830

[45] Date of Patent: Jun. 10, 1997

[54] CONTACT MOVEMENT PREVENTION STRUCTURE

[75] Inventors: Shigemi Hashizawa; Hisaharu Katoh, both of Shizuoka, Japan

[73] Assignee: Yazaki Corporation, Tokyo, Japan

[21] Appl. No.: 547,140

[22] Filed: Oct. 24, 1995

[30] Foreign Application Priority Data

Oct. 25, 1994 [JP] Japan ..... 6-260531

[51] Int. Cl.[6] ..... H01R 4/00; H01R 13/40

[52] U.S. Cl. ..... 174/84 R; 174/87; 439/578; 439/583; 439/584; 403/214

[58] Field of Search ..... 174/84 R, 87; 439/578, 583, 584, 585; 403/214, 278, 281

[56] References Cited

U.S. PATENT DOCUMENTS

| | | | |
|---|---|---|---|
| 3,171,707 | 3/1965 | Powell | 339/177 X |
| 3,537,065 | 10/1970 | Winston | 339/177 X |
| 4,156,554 | 5/1979 | Aujla | 339/177 R X |
| 4,952,174 | 8/1990 | Sucht et al. | 439/584 |
| 5,217,391 | 6/1993 | Fisher, Jr. | 439/578 |
| 5,267,877 | 12/1993 | Scannelli et al. | 439/584 |
| 5,352,126 | 10/1994 | Kuboshima et al. | 439/89 |
| 5,498,176 | 3/1996 | Hashizawa et al. | 439/585 |

FOREIGN PATENT DOCUMENTS

| | | | |
|---|---|---|---|
| 4-135186 | 12/1992 | Japan | H01R 25/00 |

*Primary Examiner*—Kristine L. Kincaid
*Assistant Examiner*—Chau N. Nguyen
*Attorney, Agent, or Firm*—Sughrue, Mion, Zinn, Macpeak & Seas

[57] ABSTRACT

In a shielded connector, an opening into which a shielded wire is to be inserted is formed in a rear portion of a housing, a part of a metal shell disposed in the housing is formed as an exposed portion which is exposed on an inner periphery of the opening, a terminal is clamped to be connected to a conductor of a leading end of the shielded wire, and a contact which makes contact with the exposed portion is clamped to be connected to a braided shield portion on an outer periphery of an inner sheath. A projection which, when the terminal is fitted and fixed at a given position in the opening, interferes with the contact to block the contact from moving toward the terminal, is formed on an inner periphery of the opening.

4 Claims, 3 Drawing Sheets

CONTACT MOVEMENT PREVENTION STRUCTURE

BACKGROUND OF THE INVENTION

The present invention relates to a movement prevention structure for a shielded connector having a metal shell for an electric shield, and particularly to a movement prevention structure for a contact which connects the metal shell with a braided shield portion of a shielded wire and which is made of an electrically conductive material.

Conventionally, electromagnetic shielded connectors in which a metal case covers the outside of a resin housing or a metal plating is formed on the outside of a resin housing are often used. In such connectors, the metal case or the metal plating is exposed to the external environment, thereby producing a problem in that the metal case or the metal plating is rusted or corroded.

To cope with this, an embedded shielded connector has been proposed in which a metal shell is embedded by employing an integrally molding technique into a resin housing of an electromagnetic shielded connector.

FIG. 4 is a longitudinal section view showing a conventional embedded shielded connector under the state where the whole of the connector is assembled, and FIG. 5 is an enlarged view of a contact portion.

A housing 1 is made of a synthetic resin or the like. A substantial portion of a metal shell 3 is embedded into the housing. Only a part of the metal shell 3 is exposed as an exposed portion 3*a* on, for example, an inner periphery of a rear opening of the housing 1.

On the other hand, in a shielded wire 5, an inner sheath 9 is peeled off so that a conductor 11 is exposed, and a terminal 13 is clamped to be connected to the exposed conductor 11. A braided shield portion 15 is exposed in a position which is slightly rearward as compared with the leading end of the inner sheath 9. A contact (shield terminal) 17 having an annular clamp portion 17*a* is clamped to be connected to the braided shield portion 15. As shown in FIG. 5, the portion of the contact 17 which is behind the annular clamp portion 17*a* is increased in diameter so as to be formed as a contact portion 17*b* making contact with the exposed portion 3*a*.

As described above, the shielded wire 5 to which the terminal 13 and the contact 17 are clamped, is connected to the housing 1 by fitting the terminal 13 and the contact 17 into the housing 1. This causes the braided shield portion 15 and the exposed portion 3*a* to be electrically connected to each other through the contact 17 so as to constitute a magnetic shield wall covering the inner conductor. In the figures, 19 designates a rubber plug which is attached to the shielded wire 5 to seal a gap between the inner periphery of the housing and the shielded wire 5, and 21 designates a rear holder which holds the rubber plug 19.

However, the above-described conventional shielded connector has a problem as follows. When the fixing force exerted by the clamp connection of the contact 17 to the braided shield portion 15 is small, as shown by the arrow in FIG. 6, vibrations or the like cause the contact 17 to move toward the terminal 13 along a tapered face 23 (see FIG. 5) for guiding the insertion of a terminal, and the leading end of the contact 17 may make contact in some cases with the terminal 13 so that the terminal 13 and the braided shield portion 15 are short-circuited.

SUMMARY OF THE INVENTION

The present invention has been conducted in view of the circumstances described above. It is an object of the invention to provide a contact movement prevention structure in which, even when the force of fixing a contact to a braided shield portion is small, the contact is prevented from moving toward a terminal, thereby improving the reliability of a shielded connector.

In order to attain the object, the contact movement prevention structure of the invention is a contact movement prevention structure for a shielded connector in which an opening into which a shielded wire is to be inserted is formed in a rear portion of a housing, a part of a metal shell disposed in the housing is formed as an exposed portion which is exposed on an inner periphery of the opening, a terminal is clamped to be connected to a conductor of a leading end of the shielded wire, and a contact which, when the shielded wire is inserted, makes contact with the exposed portion and which is made of an electrically conductive material, is clamped to be connected to a braided shield portion on an outer periphery of an inner sheath, wherein a projection which, when the terminal is fitted and fixed at a given position in the opening, interferes with the contact to block the contact from moving toward the terminal, is formed on the periphery of the opening.

When a shielded wire is inserted into the housing, the contact which is clamped to be connected to the braided shield portion, makes contact with the exposed portion, the contact portion interferes with the projection, and the leading end of the contact is disposed behind that of the inner sheath from which the conductor is exposed, whereby a sufficient insulation distance is attained between the contact and the terminal. Even when the fixing force of the contact is small and hence the contact can relatively move with respect to the braided shield portion, the contact is blocked from moving toward the terminal and therefore the insulation distance is not shortened.

DETAILED DESCRIPTION OF THE INVENTION

Hereinafter, preferred embodiments of the contact movement prevention structure of the invention will be described in detail with reference to the accompanying drawings.

Figure 1:
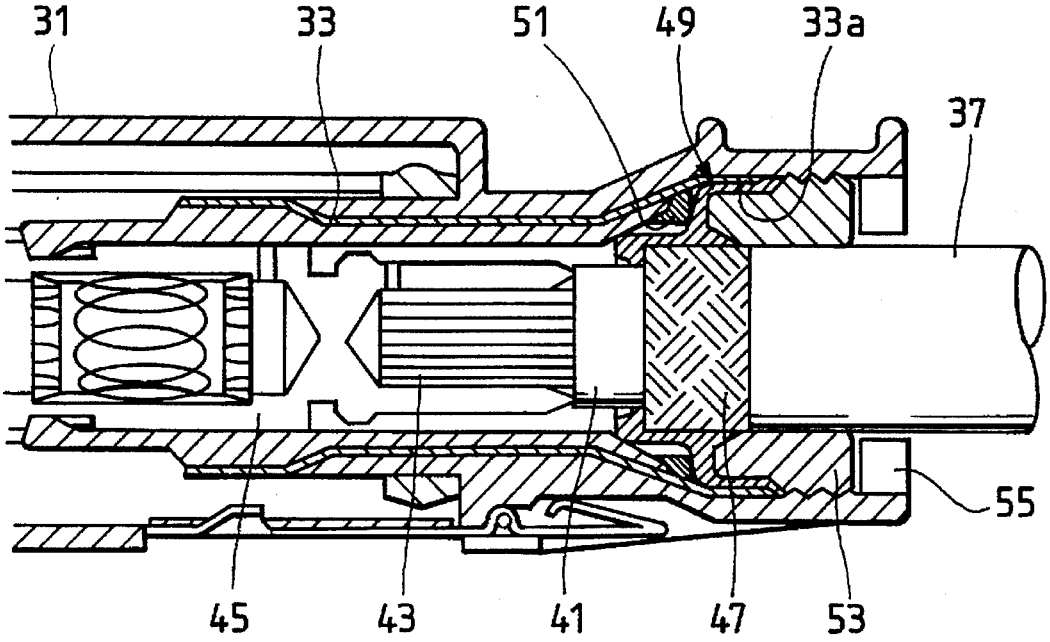
FIG. 1. is a longitudinal section view of a shield connector having the contact movement prevention structure of an embodiment of the invention.
Figure 2:
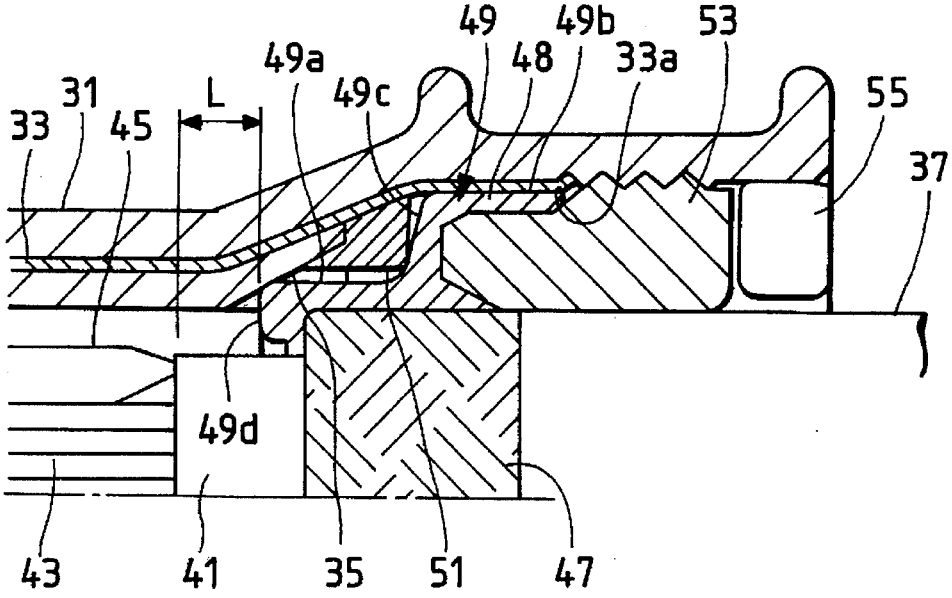
FIG. 2 is an enlarged view of a contact portion of FIG. 1.

FIG. 1 is a longitudinal section view of a shielded connector having the contact movement prevention structure of the invention, and FIG. 2 is an enlarged view of a contact portion.

A housing 31 is made of a synthetic resin or the like. A substantial portion of a metal shell 33 is disposed in the housing. The metal shell may be inserted into the housing or the housing may be molded around the metal shell so that the metal shell is disposed in the housing. Only a part of the metal shell 33 is exposed as an exposed portion 33*a* on an inner periphery of a rear opening of the housing 31. A tapered face 35 (see FIG. 2) the diameter of which is gradually reduced is formed on the inner periphery of the housing which is in front of the exposed portion 33*a*. The tapered face 35 serves as a guide face in the process of inserting a terminal.

On the other hand, in a shielded wire 37, an inner sheath 41 is peeled off so that a conductor 43 is exposed, and a terminal 45 is clamped to be connected to the exposed conductor 43. A braided shield portion 47 is exposed in a position which is slightly rearward as compared with the leading end of the inner sheath 41. A contact 49 is clamped so as to be connected to the braided shield portion 47. The contact 49 is configured by fitting a metal piece having an annular clamp portion 49*a* onto an electrically conductive rubber member 48. A contact portion 49*b* having a larger diameter is formed at a position which is behind the annular clamp portion 49*a* of the contact 49. When the shielded wire 37 is to be connected, the contact portion 49*b* makes contact with the exposed portion 33*a* of the metal shell 33.

Alternatively, the contact 49 may be made of electrically conductive rubber. In the case where the contact 49 is made of electrically conductive rubber, the contact 49 made of electrically conductive rubber is fitted onto the outer periphery of the braided shield portion 47 so that the inner periphery of the contact makes contact with the braided shield portion 47 and the outer periphery is pressed by the exposed portion 33*a*. This allows the braided shield portion 47 and the exposed portion 33*a* to be electrically connected to each other, and the contact 49 made of electrically conductive rubber to seal the rear opening of the housing.

Figure 3:
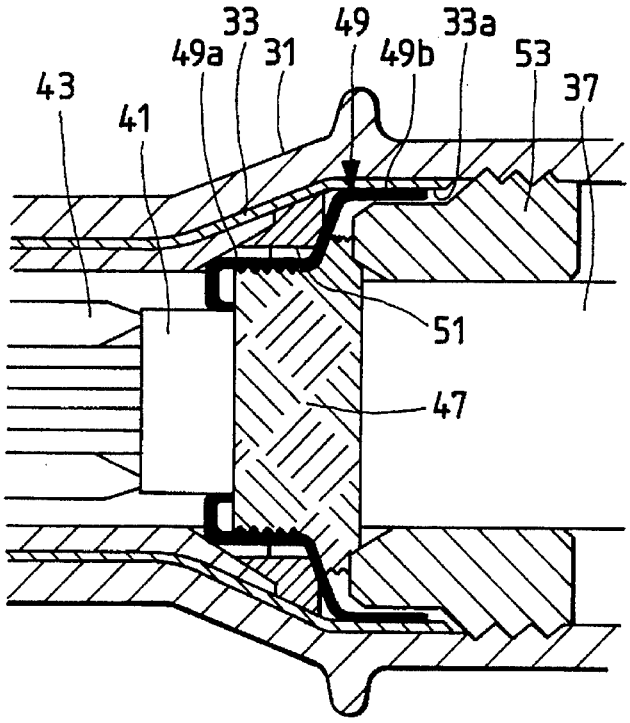
FIG. 3 is an enlarged view of a contact portion of a modification of the invention.
Figure 4:
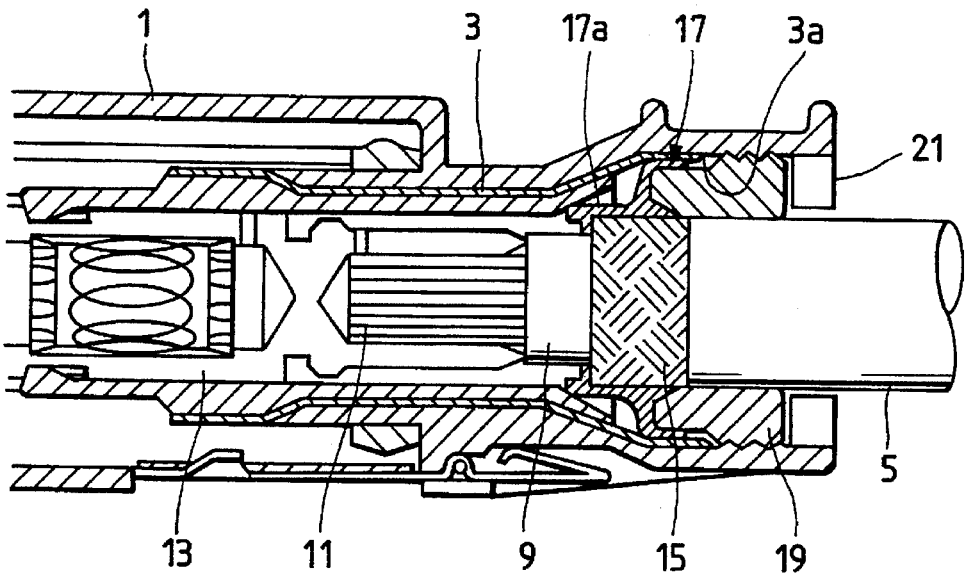
FIG. 4 PRIOR ART
FIG. 4 is a longitudinal section view of a conventional embedded shielded connector under the state where the whole of the connector is assembled.
Figure 5:
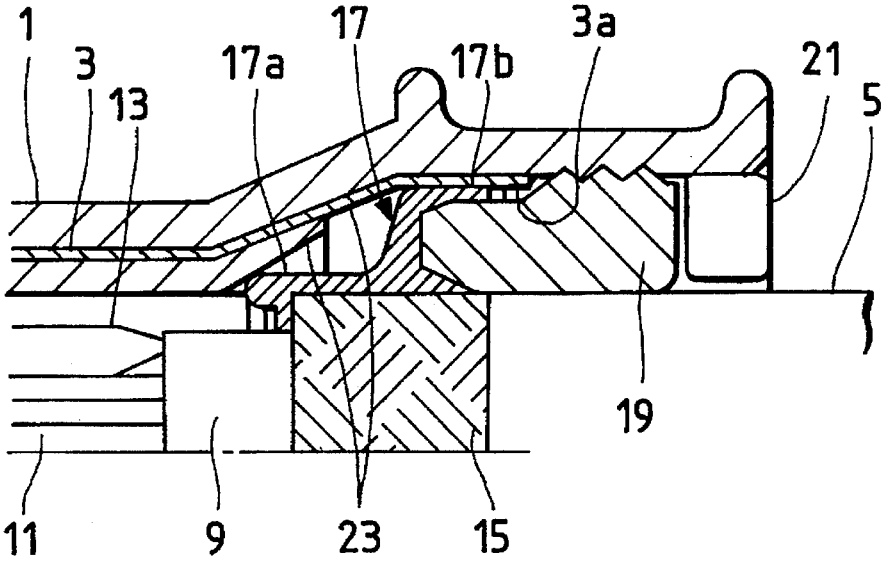
FIG. 5 PRIOR ART
FIG. 5 is an enlarged view of a contact portion of FIG. 4.
Figure 6:
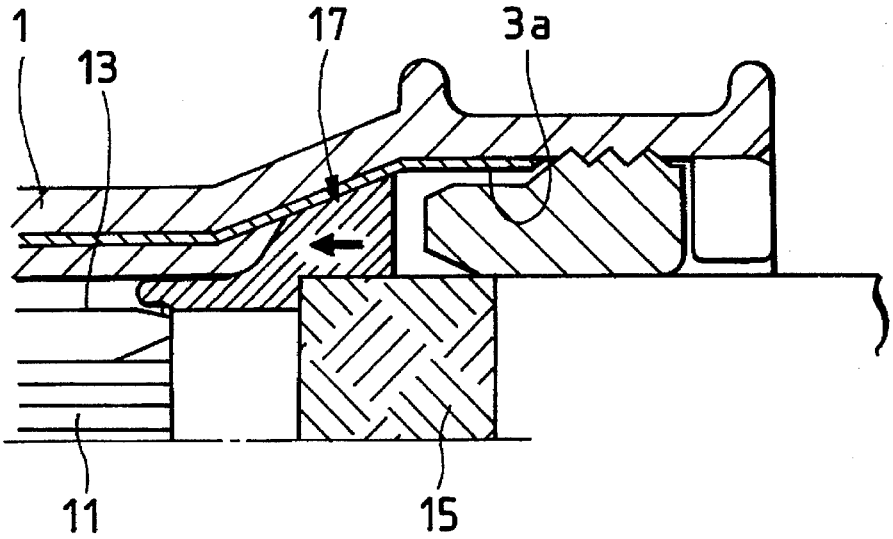
FIG. 6 PRIOR ART
FIG. 6 is an enlarged view of a contact portion which is used in a prior art structure and makes contact with a terminal as a result of a movement.

Alternatively, as shown in FIG. 3, the contact 49 may consist of only a metal piece so that the conductive rubber member 48 (see FIG. 2) is not required. In this case, when the contact 49 is clamped to be connected to the braided shield portion 47, the braided shield portion 47 is gathered by the annular clamp portion 49*a* of the contact 49 so as to be shortened in the axial direction. When the braided shield portion 47 is shortened, the contact 49 is pressed by the reaction force due to the flexibility of the braided shield portion 47 itself, and hence the braided shield portion 47 suitably makes contact with the contact 49 so that the electrical connection between the two components is attained. When the shielded wire 37 is to be connected, the contact portion 49*b* of the contact 49 which is increased in diameter makes contact with the exposed portion 33*a* of the metal shell 33.

A projection 51 is "formed on the tapered face 35 of the inner periphery of the housing." The projection 51 butts against a contact portion front end face 49*c* of the contact 49 which makes contact with the exposed portion 33*a* and inserted by a predetermined depth. In other words, the configuration in which the projection 51 formed on the tapered face 35 butts against the contact 49 blocks the contact 49 from moving in the insertion direction. In order to maintain the guiding function exerted by the tapered face 35 when the terminal is inserted, it is preferable to form the projection 51 as about two or three pieces which are disposed on the tapered face 35 and independent from each other. Alternatively, the projection 51 may be formed as an annular step on the surface of the tapered face 35. The projection 51 may be formed by expanding the inner periphery of the housing with padding, or by fixing a member which is separately formed, to the inner periphery.

In the contact movement prevention structure in the shielded connector wherein the components are configured as described above, the terminal 45 is fitted into the housing 31, the contact 49 makes contact with the exposed portion 33*a* of the metal shell 33, and the contact portion front end face 49*c* of the contact 49 butts against the projection 51, thereby connecting the shielded wire 37 to the housing 31. A rubber plug 53 attached to the shielded wire 37 seals a gap between the inner periphery of the housing and the shielded wire 37. A rear holder is fitted into the inner periphery of the housing behind the rubber plug so that the rubber plug 53 and the shielded wire 37 are held so as not to be slipped off.

In the thus configured contact movement prevention structure in the shielded connector, the contact 49 which is clamped to be connected to the braided shield portion 47 makes contact with the exposed portion 33*a*, and the contact portion front end face 49*c* butts against the projection 51, whereby the leading end of the contact 49, i.e., the leading end 49*d* (see FIG. 2) of the annular clamp portion 49*a* is caused to be located at a position slightly rearward as compared with the leading end of the inner sheath 41 from which the conductor 43 is exposed. This ensures a sufficient insulation distance L (see FIG. 2) between the contact and the terminal 45. In the structure, even when the fixing force exerted by the annular clamp portion 49*a* is so small that the annular clamp portion 49*a* can relatively move with respect to the braided shield portion 47, the contact portion front end face 49*c* butts against the projection 51 and the contact 49 is blocked from moving toward the terminal 45 so that the insulation distance L is prevented from being shortened. In other words, the predetermined insulation distance L is always ensured, and therefore the terminal 45 and the contact 49 are surely prevented from making contact with each other.

As described above in detail, according to the contact movement prevention structure of the invention, the projection which, when the terminal is fitted and fixed at a given position in the opening, interferes with the contact to block the contact from moving toward the terminal, is formed on an inner periphery of the opening. Even when the fixing force of the contact is so small that the contact can relatively move with respect to the braided shield portion, therefore, the contact is blocked from moving toward the terminal and hence the insulation distance is not shortened. As a result, the terminal and the contact are surely prevented from making contact with each other, and hence the reliability of the shielded connector can remarkably be improved.

What is claimed is:

1. A contact movement prevention structure for a shielded connector in which an opening into which a shielded wire is to be inserted is formed in a rear portion of a housing, a part of a metal shell disposed in said housing is formed as an exposed portion which is exposed on an inner periphery of said opening, a terminal is clamped to be connected to a conductor of a leading end of said shielded wire, and a contact which, when said shielded wire is inserted into said opening, makes contact with said exposed portion and which is made of an electrically conductive material, is clamped to be connected to a braided shield portion on an outer periphery of an inner sheath of said shielded wire, wherein said contact movement prevention structure comprises a projection formed on the inner periphery of said opening, and secured to said housing said projection interfering with said contact to block said contact from moving toward said terminal when said terminal is fitted and fixed at a given position in said opening.

2. A contact movement prevention structure for a shielded connector in which an opening into which a shielded wire is to be inserted is formed in a rear portion of a housing, a part of a metal shell disposed in said housing is formed as an exposed portion which is exposed on an inner periphery of said opening, a terminal is clamped to be connected to a conductor of a leading end of said shielded wire, and a contact which, when said shielded wire is inserted into said opening, makes contact with said exposed portion and which is made of an electrically conductive material, is clamped to be connected to a braided shield portion on an outer periphery of an inner sheath of said shielded wire, wherein said contact movement prevention structure comprises a projection formed on the inner periphery of said opening, said projection interfering with said contact to block said contact from moving toward said terminal when said terminal is fitted and fixed at a given position in said opening, wherein said projection is an expanded portion of a part of the inner periphery of said opening.

3. A contact movement prevention structure according to claim 1, wherein said projection comprises a plurality of independent projections formed on the inner periphery of said opening.

4. A contact movement prevention structure according to claim 1, wherein said projection is an annular step formed on the inner periphery of said opening.

* * * * *